United States Patent [19]

Hawk

[11] 4,025,205

[45] May 24, 1977

[54] PAINT ROLLER SUPPORT FOR PAINT TRAY

[75] Inventor: Gary D. Hawk, Iola, Kans.

[73] Assignee: Harding Development Company, Clearwater, Fla.

[22] Filed: Dec. 1, 1975

[21] Appl. No.: 636,684

Related U.S. Application Data

[63] Continuation-in-part of Ser. No. 549,639, Feb. 13, 1975, Pat. No. 3,947,135, which is a continuation-in-part of Ser. No. 380,603, July 19, 1973, Pat. No. 3,870,420.

[52] U.S. Cl. ..... 401/121; 15/230.11; 15/257.06; 24/84 B

[51] Int. Cl.[2] ..... B44D 3/12

[58] Field of Search ..... 401/121; 15/257.05, 15/257.06; 24/81 B, 84 B

[56] References Cited

UNITED STATES PATENTS

| | | | |
|---|---|---|---|
| 643,855 | 2/1900 | Williamson | 401/121 |
| 2,794,199 | 6/1957 | Schueler | 401/121 |
| 3,019,954 | 2/1962 | Faltin | 24/84 B X |
| 3,087,190 | 4/1963 | Werner | 401/121 |
| 3,275,818 | 9/1966 | Campbell | 24/81 B X |
| 3,575,371 | 4/1971 | Carlstgdt | 24/84 B X |
| 3,870,420 | 3/1975 | Hawks | 401/121 |

FOREIGN PATENTS OR APPLICATIONS

| | | | |
|---|---|---|---|
| 25,230 | 11/1911 | United Kingdom | 401/121 |

*Primary Examiner*—Lawrence Charles
*Attorney, Agent, or Firm*—Cullen, Settle, Sloman & Cantor

[57] ABSTRACT

A paint roller support member for use with a paint tray, the tray including substantially coplanar front and rear ends, a paint well adjacent to and below the rear end for storing a supply of paint, and an inclined surface tapering upwards from the well to the front end for rolling excess paint off the roller. The tray and the roller support member coact for supporting at least one portion of the paint roller above the well and with the paint roller handle resting on the front end of the tray thereby allowing excess paint from the roller to drip back into the well.

8 Claims, 15 Drawing Figures

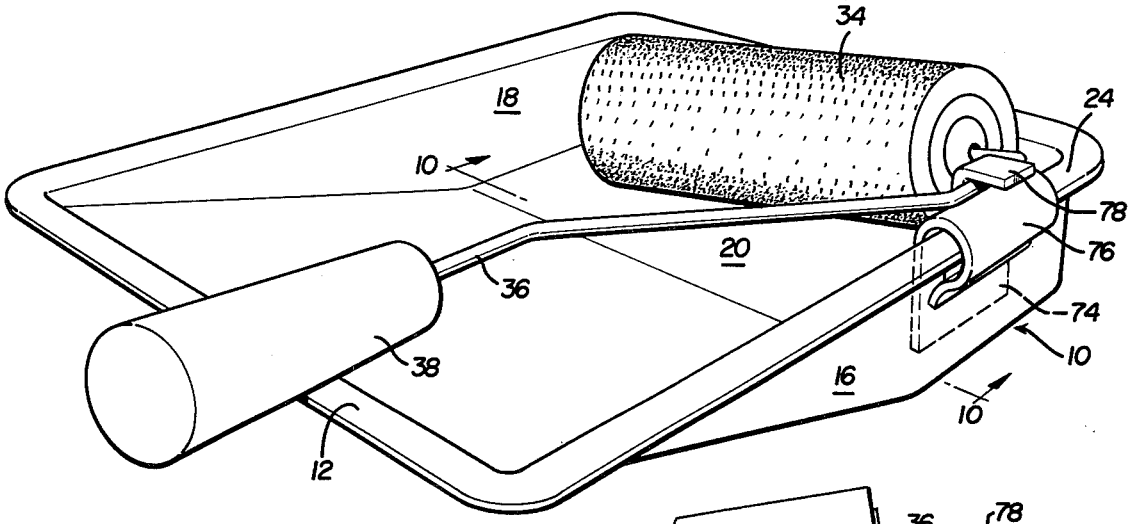
FIG. 9
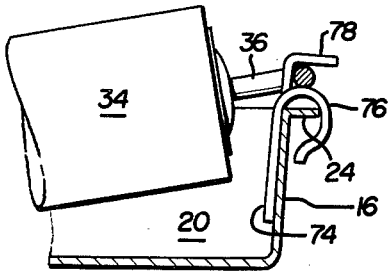
FIG. 10
FIG. 11
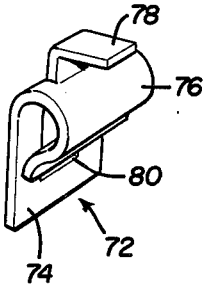
FIG. 12
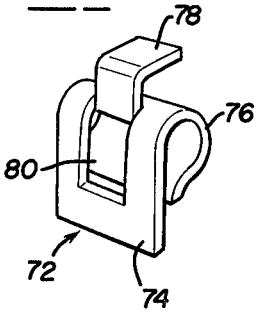
FIG. 13
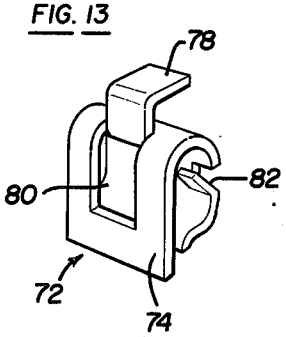
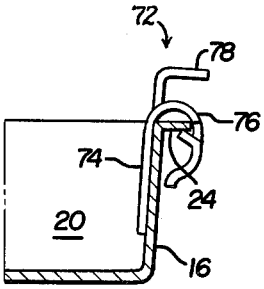
FIG. 14
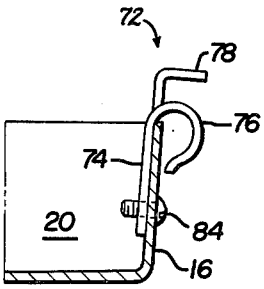
FIG. 15

PAINT ROLLER SUPPORT FOR PAINT TRAY

CROSS-REFERENCE TO RELATED APPLICATIONS

This is a continuation-in-part of my copending application Ser. No. 549,639, filed Feb. 13, 1975 now U.S. Pat. No. 3,947,135 which is a continuation-in-part of my then copending application Ser. No. 380,603, filed July 19, 1973, and now U.S. Pat. No. 3,870,420 of Mar. 11, 1975.

BACKGROUND OF THE INVENTION

Conventional paint trays, for use with rollers in applying paint to wall surfaces, are made of cardboard or metal in a roughly rectangular shape. The tray typically has a depression or well near one end into which the painter pours a supply of paint. The well terminates in an inclined surface upon which the painter may roll the paint roller to remove excess paint therefrom.

During periods of non-use of the roller, the painter conventionally places the roller upon the tray with the paint applying portion resting on the inclined surface. All too often, the paint roller flips out of the tray or rolls into the well causing paint to splash out. In the event that neither of these undesirable results occur, storage of the roller on the inclined surface tends to flatten one side of the roller surface which is usually manufactured of a wool-like material or flocking or the like.

Finally, when the time comes to clean and store the paint tray, storage is normally accomplished by merely placing the tray on a shelf or the like. This occupies unnecessary space because of the irregular shape of the tray.

Thus, it is desirable to provide a paint tray which includes an improved mechanism for holding a paint roller during periods of non-use and a tray which may be conveniently stored after use.

In providing these features for a paint tray, several factors must be appreciated. First, the painter normally has several tools and each additional, independent tool merely adds to the bulk which the painter must carry from job location to job location. Thus, an independent paint roller stand is impracticable. Second, paint trays and the like are typically inexpensive and have a short useful life and it is extremely important that additional features for paint trays be relatively inexpensive.

Third, any feature added to a paint tray must not interfere with the primary function of the tray, namely, a paint reservoir for use with a paint roller in applying paint to a surface.

Hence, the invention herein relates to an improvement in conventional paint trays, namely, means for supporting a roller and for providing for storage of the tray during the periods of non-use.

SUMMARY OF THE INVENTION

The invention herein relates to providing a simple inexpensive support means as part of a paint tray or as part of the roller, or fastenable to the tray or roller, which serves to support and hold at least part of the roller above the well of the paint tray during periods of roller non-use. The support means must be extremely inexpensive and must hold the paint roller in such a way that no flattening occurs to the paint applying portion of the roller. In one embodiment, the support means may also be used to store the tray during periods of non-use. Preferably the support means holds the roller so that the roller handle rests on the front end of the tray.

Finally, the improvements of the present invention are extremely inexpensive and do not materially add to the cost of the tray which is a very important factor in this type of competitive disposable device.

BRIEF DESCRIPTION OF THE DRAWINGS

In the drawings, wherein like reference numerals identify corresponding parts:

FIG. 9 is a perspective illustration of another embodiment of a paint roller support means;

FIG. 10 is a fragmentary sectional view of the paint tray, paint roller and support means as seen in the plane of arrows 10—10 of FIG. 9;

FIG. 11 is a perspective illustration of the support means of FIGS. 9 and 10;

FIG. 12 is another perspective illustration of the support means of FIGS. 9 and 10;

FIG. 13 is a perspective illustration of the support means of FIGS. 9 and 10 modified to engage the flange of the paint tray;

FIG. 14 is a side elevational view, partly in section, of the support means of FIG. 13 engaging the paint tray; and FIG. 15 is a perspective illustration of the support means of FIGS. 9 and 10 attached to a paint tray.

DETAILED DESCRIPTION OF THE INVENTION

Figure 1:
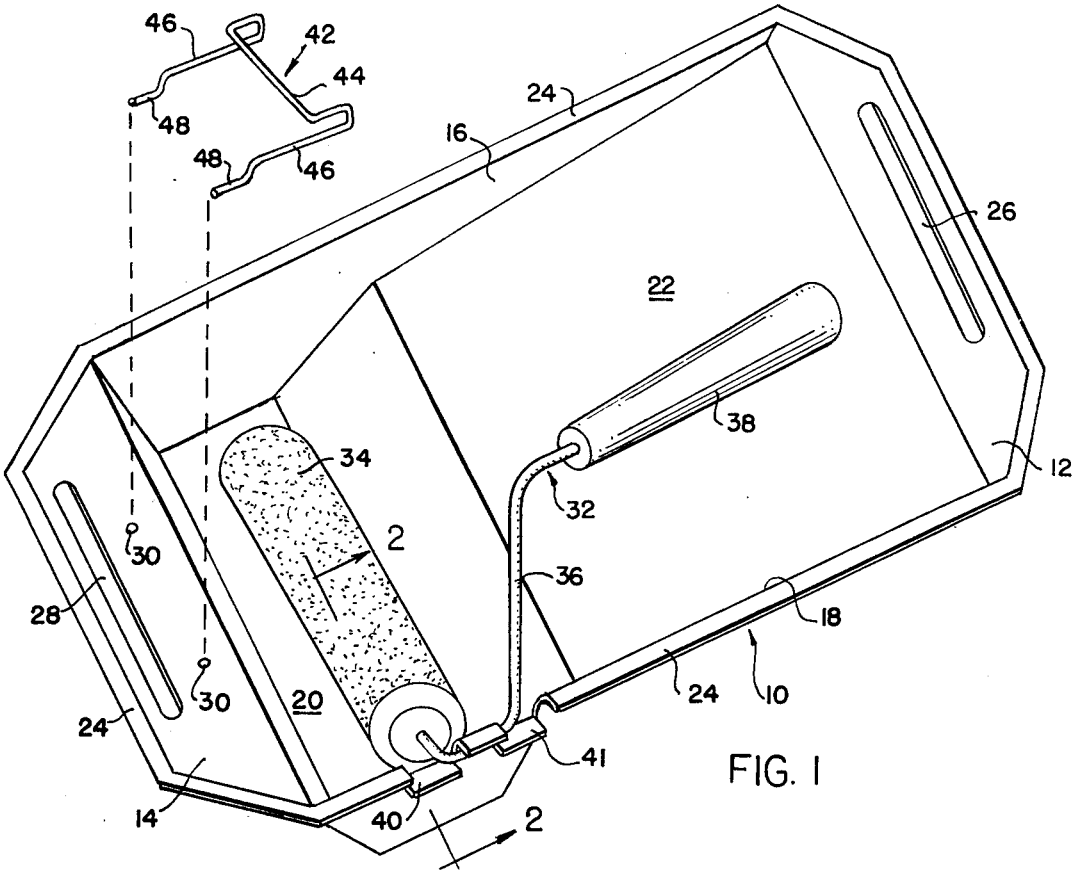
FIG. 1 is a perspective illustration of a paint tray and a paint roller having coacting support means according to the principles of the present invention.

FIG. 1 illustrates a conventional paint tray 10 having a front end 12 and a rear end 14, each including substantially coplanar surfaces. The tray has opposed side walls 16 and 18, a well portion 20 positioned adjacent to one end 14 for the storage of paint or the like, and an integral inclined surface 22 tapering upwardly from the paint well 20 to the front end 12.

The paint tray includes a peripheral outwardly extending, lateral flange 24, and optional front and rear hand holds 26 and 28 in the coplanar front and rear surfaces, respectively. The hand holds may be utilized for carrying the tray from one location to another and is especially beneficial when there is a supply of paint in the well. The rear surface 14 of the tray also includes a plurality of apertures 30.

Illustrated in FIG. 1 is a conventional paint roller 32 having a paint applying portion 34 of a wool-like or flocking material or other conventional material, a bent wire or support rod or frame 36 having the paint applying portion 34 mounted on one end thereof, and a handle 38 mounted on the other end of the frame.

Means are provided for supporting the paint roller on the paint tray above the well 20 so that any paint on the roller drips back into the well thus avoiding wasting paint.

Figure 2:
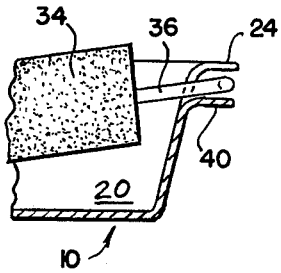
FIG. 2 is a fragmentary sectional view of the tray, roller and support means as seen in the plane of arrows 2—2 of FIG. 1.

Specifically, in a first embodiment, FIGS. 1 and 2, a second short flange 40 is provided in the region of the rear surface or end, 14 and the well 20. The second flange 40, which may include multiple sections as at 41, is vertically in a different plane from the main peripheral flange 24.

The vertical spacing between the main flange 24 and the second flange 40 is such that the wire rod 36 may be removably force-fit or frictionally retained therebetween. With the rod so positioned, and with the handle 38 of the roller resting on the inclined surface 22 or on the end 12 of the tray, the paint applying portion 34 of the roller is suspended above the well. One end of the paint applying portion may tip down into the well and touch the bottom of the well depending upon the degree of freedom and slippage between the flanges and the rod.

With rod 36 force-bit between the flanges, the roller is supported over the well and is secured against splashing into the well or against tipping outwardly of the tray. The flange arrangement is totally unobtrusive and does not affect use of the paint tray or roller in any fashion.

It should be noted that in the manufacture of a tray having this feature, it is merely necessary to bend down portions of the peripheral flange 24 to form the second flange sections 40 and 41.

Another means for supporting the paint roller is also illustrated in FIG. 1 and includes a wire rod 42 formed into a U-shape and having a wide base 44 and a pair of first legs 46. The first legs are bent into an S-shape and extend from the base of the rod to form a pair of second legs 48.

In operation, the second legs 48 are inserted in the apertures 30 in the rear surface of the paint tray. The second legs are inserted up to the "S" portion, at which time the base 44 of the rod extends over the paint well. The base and the first legs form a support upon which the paint roller may be placed. In this fashion, any paint on the roller will drip down into the well.

Figure 3:
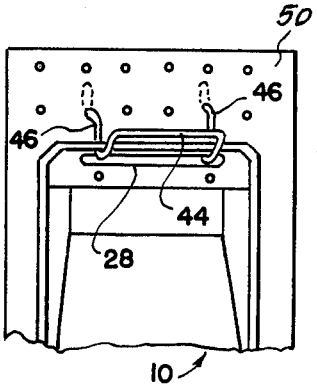
FIG. 3 is a fragmentary elevation view of a support means for storing the paint tray.

When it is desired to store the paint tray after use, the wire rod 42 is removed from the apertures 30 and inserted into apertures in a conventional pegboard 50 as seen in FIG. 3. The handle hold 28 is slipped over the base 44 of the wire rod and the paint tray may be suspended in a vertical fashion to occupy a minimum of storage space.

Figure 4:
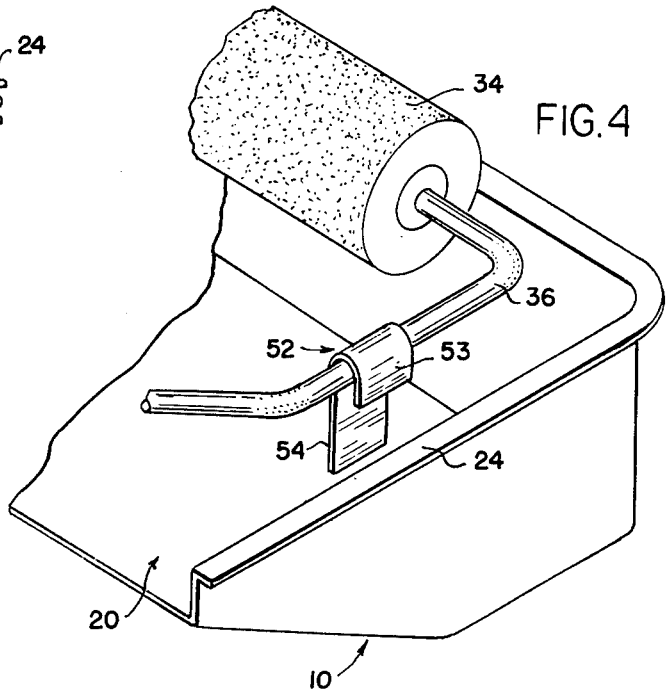
FIG. 4 is a partial perspective illustration of another embodiment of a support means.

An alternate form of support means is illustrated in FIG. 4 including a clip 52 for securing the roller and tray together. The clip 52 is of a generally "U"-shaped configuration having a base and first and second legs 53, 54. The clip is attached to the bent portion of the wire rod 36, either by welding or by a force-fit, with the legs extending downwardly perpendicular to the rod. The spacing between the legs defines a slot to receive the tray flange 24 so that the clip may be releasably force-fit onto the flange 24. Thus the roller 32 is supported by the tray 10 with the paint applying portion over the paint well 20.

Figure 5:
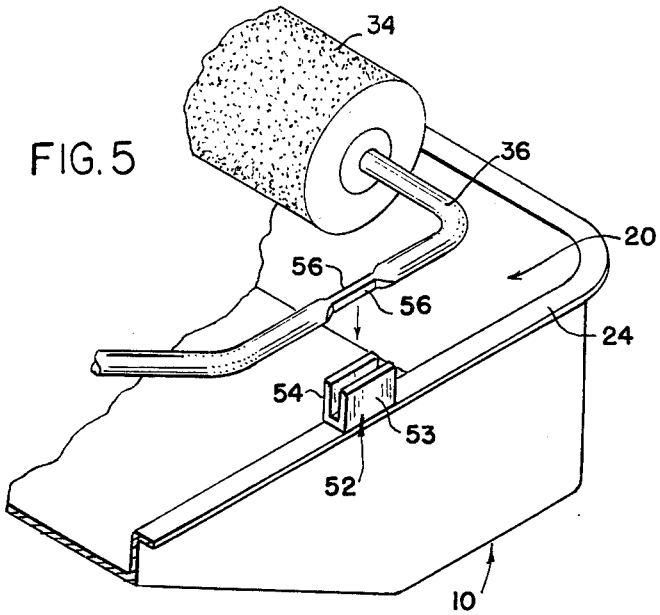
FIG. 5 is a fragmentary perspective illustration of another embodiment of a support means for holding the paint roller over the well of the paint tray.

In the embodiment of FIG. 5, the clip 52, having a base and spaced apart legs 53 and 54, has the base welded to the flange 24 with the legs extending upwardly in a channel-like configuration. Thus a slot is defined between the legs 53, 54. The wire rod 36 of the roller is provided with recesses or flats 56 of a size to fit in the slot between the legs of the clip. When it is desired to support the roller over the paint well, the wire rod 36 and specifically the recessed portions 56 are releaseably force-fit into the clip 52.

Figure 6:
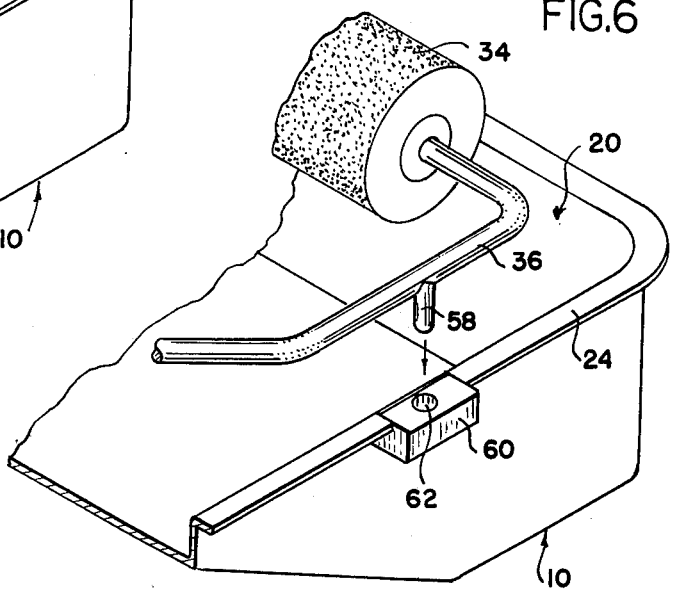
FIG. 6 is a fragmentary illustration of yet another embodiment of the present invention.
Figure 7:
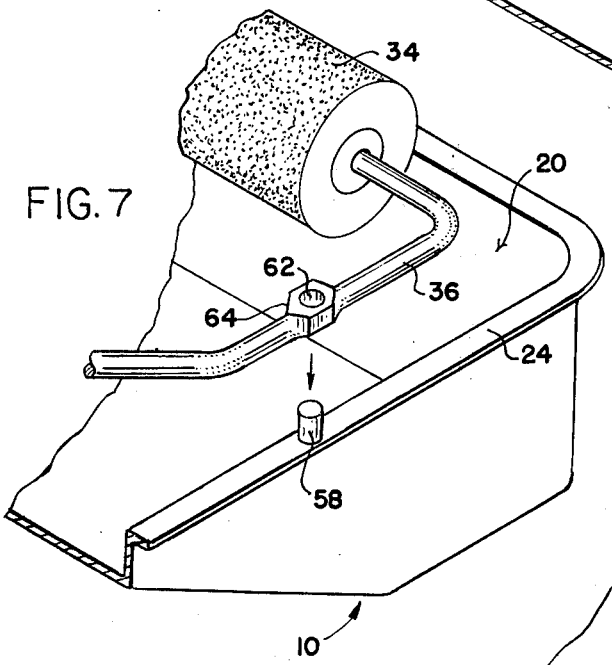
FIG. 7 is a fragmentary perspective illustration of yet another embodiment of the present invention.

The embodiments of FIGS. 6 and 7 rely on the coaction of a post or stud and an aperture for supporting the roller above the paint well.

In FIG. 6 the wire rod 36 includes a downwardly projecting post or stud 58. Extending laterally outwardly from flange 24 is an auxiliary flange 60 having a suitable aperture 62 of a size and shape to receive the post 58. When the post is inserted in the aperture, the paint applying portion is supported above the paint well.

In FIG. 7 the flange 24 includes an upwardly extending post or stud 58. The wire rod 36 includes an aperture 62 therethrough to receive the post. If necessary, a portion of the rod may be of enlarged diameter, as at 64, to accommodate the aperture 62 without the resultant loss of strength in the rod.

Figure 8:
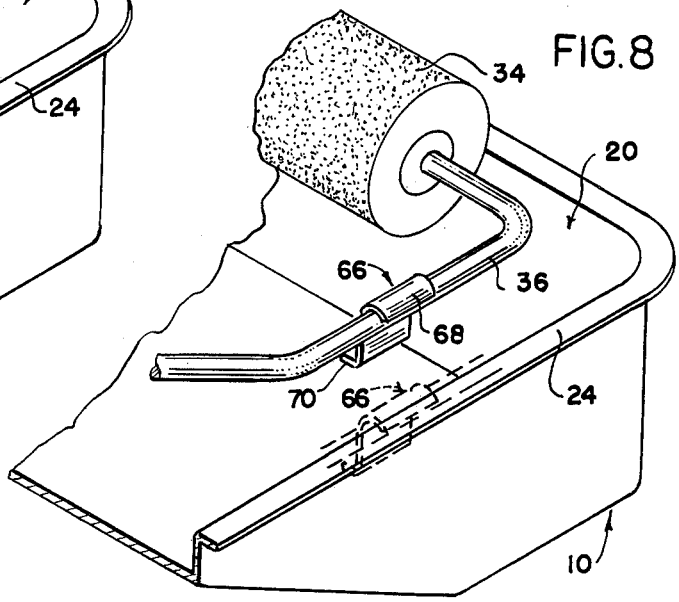
FIG. 8 is a fragmentary perspective illustration of still another embodiment of the present invention.

In FIG. 8, a clip 66 is provided having a generally S-shaped configuration. One leg is welded to the rod 36, as at 68. The other leg 70 is removably hooked under the flange 24 of the tray when it is desired to support the roller over the paint well. As illustrated, clip 66 is oriented to be hooked under flange 24 by moving the roller toward the tray from the exterior thereof.

When the paint tray is made of cardboard, the flange support concept of FIGS. 1 and 2 may only have a limited useful life before the cardboard rips or tears and the strength of the cardboard flange may be insufficient to retain the clip of FIGS. 4 and 8. In addition, when either cardboard or light, thin metal paint trays are used, such as the disposable type trays, the flange may be of insufficient strength to support the weight of the roller.

To overcome these problems, a different type of support means is provided to distribute the weight of the roller onto the side wall of the tray.

Specifically, as illustrated in FIGS. 9–15, a support member 72 is provided having a flat base 74 and a first curved leg 76 which is formed at one end of the base. A second leg 78 is struck out from the base 74 and bent toward and outwardly of the first leg to that the legs 76, 78 are spaced apart to define a slot therebetween. Striking the second leg 78 from the base leaves an aperture or opening 80 in the base.

In operation, the support member is dropped over the side and flange of the tray with the base 74 interiorly of the tray and with the first curved leg 76 extending over the flange 24 and then hooked under the flange. The wire rod 36 of the roller is then frictionally force-fit into the slot between the legs 76, 78. The weight of the roller causes the bottom or free end of the base 74 to abut against the interior side wall 16 of the tray thus distributing the weight of the roller and also preventing the support member from becoming disengaged.

Thus the support member 72 actually includes two slots; a first slot between the base 74 and curved leg 76 to receive the tray and a second slot between the two legs 76, 78 to receive the roller rod.

Optionally, a portion of the curved leg 76 may be bent inwardly toward base 74 as a tab 82 to lock under or engage the flange 24 of the tray as illustrated in FIGS. 13 and 14. This is extremely beneficial in accommodating the support member to different configurations of paint trays.

Finally, since some metal paint trays are provided without a flange, a screw 84 may be used to attach the base 74 of the support member to the tray side wall. Obviously, the screw 84 may also be used even with those paint trays which do include a flange 24.

In the embodiments of FIGS. 4, 5 and 8, and 9–15 the clip is preferably of a springy material to provide a tight force fit. Where welding is to be utilized, as previously explained, the springy material is metal. Where welding is not being used the clip material may be either metal or plastic.

The foregoing is a description of operative embodiments of the present invention and should not be read in a limiting sense but only as describing the underlying inventive concepts. The invention may be further developed within the scope of the following claims.

What is claimed is:

1. In a paint tray for use with a paint roller or the like, said paint roller having a bent wire rod supporting a paint applying portion at one end and having a handle at the other end, said paint tray including substantially coplanar front and rear ends, opposed side walls, a paint well adjacent to said rear end for storing a supply of paint, an integral inclined surface tapering upwardly from said paint well to said front end for rolling excess paint off said paint applying portion whereby excess paint flows into said well, and a peripheral upper flange, the improvement comprising:

a small relatively thin support member defining a horizontally disposed, laterally opening slot vertically above said paint tray flange for retaining said bent wire rod and said paint tray together for supporting the paint applying roller above the paint well;

said support member having a base and first and second spaced apart legs extending outwardly from said base, said first and second legs defining said slot therebetween and said legs being vertically above said paint tray flange for retaining said bent wire rod therein.

2. The invention as defined in claim 1, wherein said first leg and said base define a second slot therebetween for frictionally retaining said paint tray therein, said base bearing against the interior of said paint tray side wall.

3. The invention as defined in claim 1, wherein said first leg is notched to form a projection for engaging the underside of said paint tray flange to interlock said paint tray and said support member together.

4. The invention as defined in claim 1, wherein said first leg and said base are spaced apart to receive the paint tray therebetween.

5. The invention as defined in claim 1, wherein said second leg is struck out from said base and bent toward and outwardly of said first leg to define said slot therebetween.

6. The invention as defined in claim 1, wherein one end of said base is curved, said curved end defining said first leg.

7. The invention as defined in claim 1, wherein said support member is fastened to said paint tray by a fastener.

8. The invention as defined in claim 1, wherein said support member is a generally U-shaped clip having parallel legs, said legs defining said slot therebetween, said clip also being attached to the bent wire rod of said roller and said legs extending downwardly to frictionally retainingly engage said paint tray in said slot.

* * * * *